United States Patent [19]

Kunkle

[11] 4,129,997

[45] Dec. 19, 1978

[54] PERMANENT REFRIGERANT DEHYDRATOR

[76] Inventor: Robert J. Kunkle, c/o Lyle J. Schlyer Attorney at Law, 20951 Brookhurst, Suite 3, Huntington Beach, Calif. 92646

[21] Appl. No.: 824,079

[22] Filed: Aug. 12, 1977

[51] Int. Cl.[2] ..... F25B 43/04

[52] U.S. Cl. ..... 62/475

[58] Field of Search ..... 62/195, 474, 475

[56] References Cited

U.S. PATENT DOCUMENTS

| | | | |
|---|---|---|---|
| 240,830 | 5/1881 | Klein | 62/93 |
| 258,682 | 5/1882 | Stevens | 62/475 |
| 2,019,421 | 10/1935 | Link | 62/475 |
| 2,577,598 | 12/1951 | Zwickl | 62/475 |
| 2,691,280 | 10/1954 | Albert | 62/475 |
| 2,705,405 | 4/1955 | Uhlman | 62/474 |
| 2,986,894 | 6/1961 | Endress et al. | 62/475 |
| 3,013,404 | 12/1961 | Endress | 62/195 |
| 3,145,544 | 8/1964 | Weller | 62/195 |
| 3,410,106 | 11/1968 | Brockie | 62/195 |
| 3,545,227 | 12/1970 | Grahl | 62/475 |

*Primary Examiner*—Lloyd L. King
*Attorney, Agent, or Firm*—Lyle J. Schlyer

[57] ABSTRACT

A refrigerant dehydrator, in combination with a refrigeration system of the type including a compressor, a condenser, a refrigerant expansion device, and an evaporator, incorporating a body member, of generally U-shaped configuation, surrounding a refrigerant conducting bore operationally interposed between the refrigerant expansion device and the evaporator. A sump member is connected to a lower portion of the body member and extends downward therefrom. The bore of the body member and the bore of the sump member communicate through an orifice defined by a wall of the body member. A drain valve is sealably connected to the lower end of the sump member.

9 Claims, 5 Drawing Figures

PERMANENT REFRIGERANT DEHYDRATOR

BACKGROUND OF THE INVENTION

1. Field of the Invention

This invention relates generally to mechanical refrigeration systems, and particularly to mechanisms for purging the refrigerant of said systems of foreign liquid impurities such as water.

2. Description of the Prior Art

In refrigeration systems comprising a compressor, a condenser, a refrigerant expansion device, and an evaporator, a major problem is the purging of condensible and non-condensible foreign contaminants. Of primary importance is the removal of excessive moisture introduced into the refrigeration system through leaking seals, faulty piping, introduction of moisture laden refrigerant fluid or lubricant, moisture on new parts installed in the system, condenser leaks, and evaporator leaks. It is well known that moisture accumulating in a refrigeration system adversely effects operations by causing corrosion, buildup of oil sludge, and freezing of the refrigerant expansion device.

As taught in U.S. Pat. Nos. 3,410,106, 3,145,544 and 3,013,404, purge mechanisms may be constructed utilizing a separate chamber wherein cold refrigerant is used to condense moisture drawn from the headspace of the condenser unit. As refrigerant vapors are also condensed in said purge units, piping and float valves are necessary to separate liquid refrigerant from the water to be drained. Due to the expense and mechanical limitations of said purge mechanisms, their use is primarily confined to refrigeration equipment in capacities upwards of 50 tons.

Also known to the prior art are electrostatic precipitator purge mechanisms as taught by U.S. Pat. No. 2,691,280. Use of this type of purge unit has not found wide acceptance in refrigeration systems of less than 50 tons capacity as a result of high operating costs and relatively high initial costs.

The typical dehydrator presently in use in most refrigeration systems, and, in particular, systems of relatively small capacity, is the chemical type, typically containing silica gel and activated alumina. These chemical drying agents are contained within a body suitably adapted to removably connect within a refrigerant conduit of the refrigeration system such that they may be replaced when exhausted due to adsorption of the maximum amount of moisture. While economical to install, said chemical dehydrators, as a result of their disposable design, increase maintenance expense and involve loss of refrigerant when removed for renewal.

The final purge device known in the prior art comprises a trap installed in a low leg of the piping of a refrigeration system. This trap-type purge device is adaptable to systems utilizing a refrigerant of low density such as ether or air as taught in U.S. Pat. Nos. 240,830 and 258,682. Water, being heavier than such refrigerants, will be separated by gravity and will accumulate in the trap from whence it may be drained. With the advent and use of more efficient refrigerants such as Freon 12, Freon 22, and methyl chloride, said trap-type purge devices are no longer operable; modern refrigerants, being heavier in their liquid state than water, would drain from such traps prior to the accumulated water.

SUMMARY OF THE INVENTION

In order to avoid loss of refrigerant to the atmosphere, minimize refrigeration system maintenance, and provide a reliable moisture purge system for refrigeration systems of less than 50 tons capacity, the applicant proposes incorporating a U shaped tubular body member within the conduit connecting the refrigerant expansion device and the evaporator. The body member communicates at the lowest dimension thereof with a sump member incorporating a drain valve at the base thereof. Moisture leaving the refrigerant expansion device is condensed along with a portion of the refrigerant. Said liquids are directed by gravitational forces into the sump member where liquid refrigerant is allowed to evaporate and return to the refrigeration cycle. The water remaining in the sump member may be periodically discharged through the drain valve.

BRIEF DESCRIPTION OF THE DRAWINGS

The invention may be more fully appreciated from the following detailed description of the preferred embodiment thereof taken in conjunction with the appended drawings wherein.

DETAILED DESCRIPTION OF THE DRAWINGS

Figure 1:
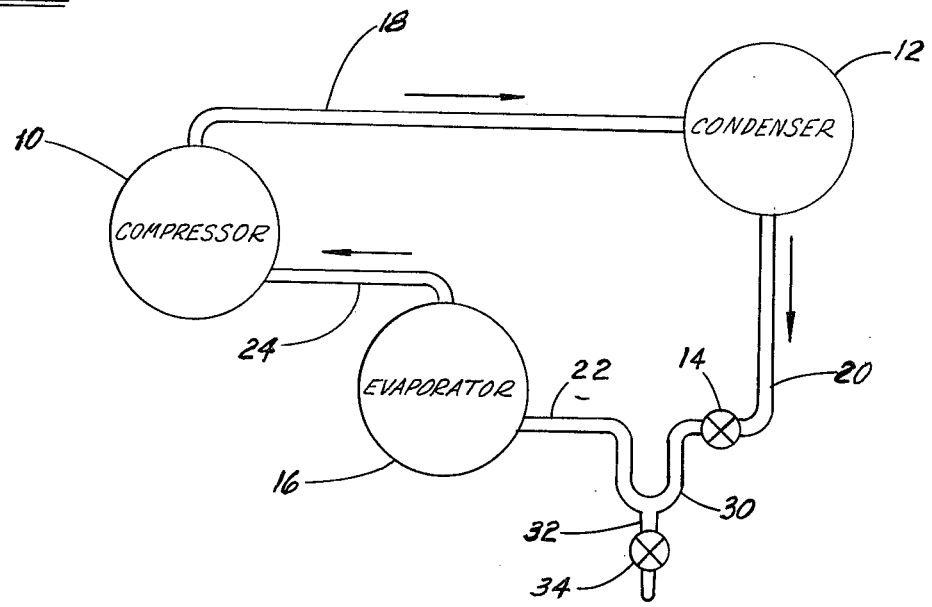
FIG. 1 is a schematic diagram of a refrigeration system incorporating this invention.

Referring now to FIG. 1, the essential components of a typical refrigeration system may be seen to include a compressor 10, a condenser 12, a refrigerant expansion device 14, an evaporator 16, and conduits interconnecting the components, thus defining a closed cyclical path. In operation, liquid or gaseous refrigerant absorbs heat in the evaporator 16 which may be a shell and tube design for cooling liquids or an open coil design for refrigerating an enclosed area or similar appropriate design. Warmed refrigerant vapors are drawn into the compressor 10 through a suction line 24 where they are compressed and directed to the condenser 12 through a high pressure conduit 18. The condenser 12, typically of shell and tube design, extracts heat from the high pressure refrigerant which refrigerant then flows through a discharge conduit 20 to the refrigerant expansion device 14 where a further decrease in temperature takes place by means of adiabatic expansion. A mixture of liquid and vapor refrigerant emerges from the refrigerant expansion device 14 and is conveyed through a low pressure conduit 22 to the evaporator 16, thus completing the cycle.

Refrigerants typically utilized in refrigeration systems as illustrated include chlorofluoromethanes such as those commonly known as Freon-12 or F-12, and Freon-22 or F-22. Water or moisture present in the refrigeration system, the detrimental effect of which has been previously described, is generally insoluble in such refrigerants, the solubility of water decreasing with decreasing temperature to a value of approximately 60 parts per million at 32° F. Thus, as a result of the depressed temperature existing in the low pressure conduit 22 the refrigerant is essentially free of dissolved moisture and any water present will be substantially in liquid state.

Incorporated within the low pressure conduit 22 may be seen the dehydrator of this invention comprising a body member 30, generally defining a U shape, a sump member 32, and a drain valve 34.

Figure 2:
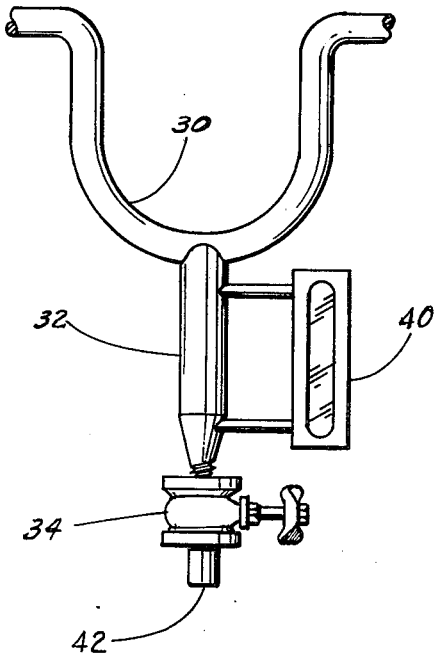
FIG. 2 is an elevation view of an embodiment of this invention.
Figure 3:
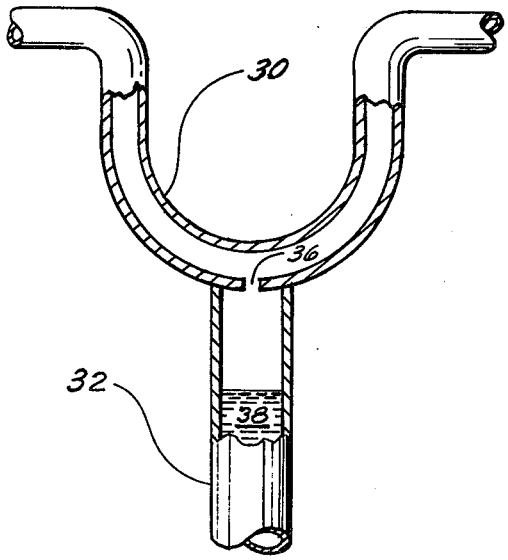
FIG. 3 is a fragmentary elevation view showing the intersection of the body member and the sump member.

As more clearly shown in FIGS. 2 and 3, the U shaped body member 30 is constructed of cylindrical tubular material, preferably copper, and is sized to correspond to the size of the low pressure conduit 22 of the refrigeration system. The low pressure conduit 22 and the body member 30 may or may not be insulated depending on the application and installation environment.

Communicating with said body member 30 and attached thereto at the base thereof is the sump member 32, also preferably copper. While the sump member 32 illustrated is generally cylindrical and tubular in design, this is not essential to the proper operation of the invention; any closed receptacle will suffice, preferably incorporating greater height than width and embodying sufficient heat transfer characteristics as will be apparent from the discussion which follows. The sump member 32 may be uninsulated an untraced in the majority of installation environments. In environments wherein ambient temperatures fall below 32° F., the sump member is preferably insulated and heated by known electrical or steam tracing methods such that the temperature of the space within the sump member 32 may be maintained above the freezing point of water during draining operations.

Interposed between the enclosed space of the body member 30 and the enclosed space of the sump member 32 may be seen an orifice 36 of sufficient dimension to allow liquid refrigerant and water to pass there through. In operation, liquid refrigerant and water discharged from the refrigerant expansion device 14 are gravitationally drawn to the lower portion of the enclosed space of the body member 30 and through the orifice 36 into the sump member 32. The sump member 32 thus collects water 38 delivered thereto. Liquid refrigerant, having a substantially lower boiling point, is evaporated and, in such low density vapor state, returns through the orifice 36 to the enclosed space of the body member 30 and thus remains in the refrigeration cycle. This operational feature is readily apparent from a consideration of the boiling point, at atmospheric conditions, of F-12 which is minus 20° F. and F-22 which is minus 40° F.

At periodic intervals, the water 38 collected in the sump member 32 may be drained by means of the drain valve 34. During said draining operation, the throttling effect of the orifice 36 serves to provide a lower pressure in the sump member 32 than exists in the body mamber 30. As the accumulated water 38 drains, the pressure in the sump member 32 decreases, allowing the operator of the drain valve 34 to close the same at the inception of any gaseous escape, thus minimizing loss of refrigerant in those refrigeration systems wherein the pressure in the low pressure conduit 22 may be substantially greater than atmospheric pressure. In refrigeration systems wherein the low pressure conduit 22 is maintained at subatmospheric pressures, a pump will be necessary to provide the motive power to extract water 38 from the sump member 32. Such pump, unshown in the drawings, may be attached permanently or removably to a discharge fitting 42 of the drain valve 34 and may be selectively activated during the draining operation.

A further aid in preventing escape of refrigerant is the addition of a sight glass 40, as shown in FIG. 2, communicating with the sump member 32 along a substantial portion of its height. The sight glass 40, as is readily apparent, also aids in determining the required frequency of draining.

Figure 4:
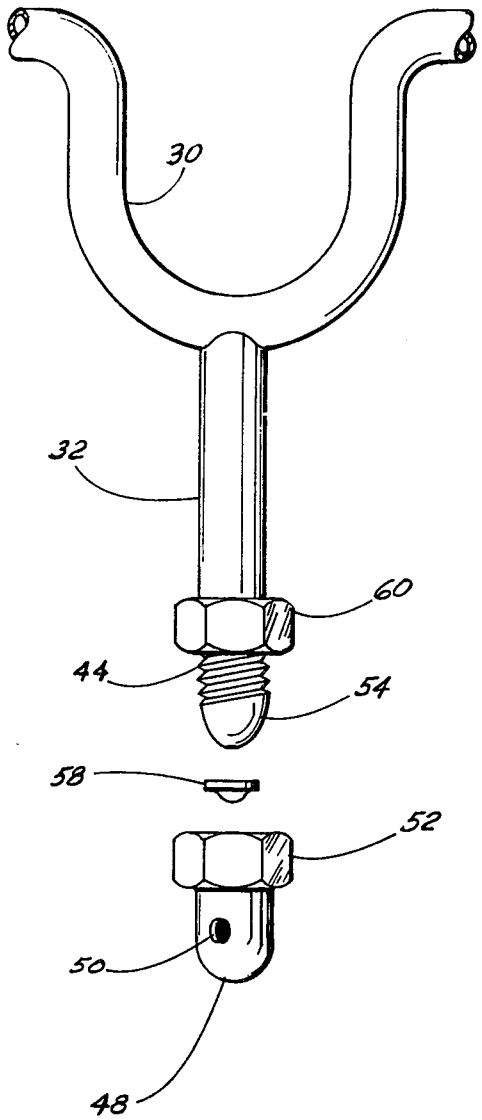
FIG. 4 is an alternative embodiment of this invention.
Figure 5:
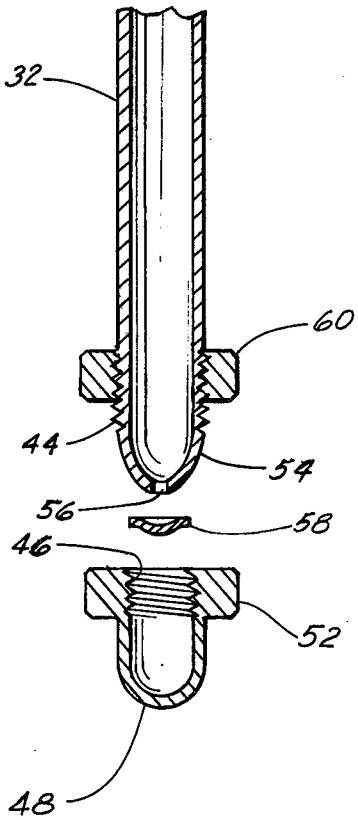
FIG. 5 is a cross-sectional view of the drain valve means of FIG. 4.

Now referring to FIGS. 4 and 5, an alternative embodiment of this invention may be seen. While the essential elements of the invention as previously described remain unchanged, the alternative embodiment incorporates a drain valve means particularly adapted for economy of construction and simplicity of operation. Said drain valve means is comprised of male threads 44 circumscribing the cylindrical tubular sump member 32 and integrally formed along the axial dimension of the lower portion thereof. Dimensionally corresponding to said male threads 44 are female threads 46 incorporated within a cap 48. Said cap 48 includes an outlet bore 50 in a cylindrical side wall thereof and an integrally formed raised shoulder portion 52 having exterior dimensions describing a standard hexagonal nut.

In the embodiment shown in FIGS. 4 and 5, the cylindrical sump member 32 incorporates a concentrical dimensionally reduced section 54 at the base thereof surrounding and describing a drainage bore 56. The sump member 32 further incorporates a hexagonal surface 60 communicating with the upper portion of said male threads 44. As illustrated, the hexagonal surface 60 is the exterior of a standard hexagonal nut in engaging relationship with the upper portion of said male threads 44 and preferably permanently attached thereto by a brazing process. A sealing member 58, preferably constructed of copper or other malleable water resistant and heat resistant gasket material, is interposed between said drainage bore 56 and the inner surface of said cap 48.

In operation, the cap 48 is removably attached to the sump member 32 by the male 44 and female 46 threads such that the sealing member 58 is held in sealing engagement with the drainage bore 56. At periodic intervals the cap 48 may be disengagably rotated to unseat the sealing member 58 and allow water accumulated in the sump member 32 to flow through the drainage bore 56, into the cap 48, and discharge through the outlet bore 50. When water no longer emerges or when gas can be heard escaping, the cap 48 may be engagably rotated to again bring the sealing member 58 into sealing engagement with the drainage bore 56. The hexagonal surfaces 52 and 60 are included to allow wrenches to be used to aid such rotation when necessary.

It is to be understood that the embodiments described above are merely examples of the application of the principles of this invention. Additional embodiments may be devised by those skilled in the art without departing from the spirit or scope of the invention.

I claim:

1. A refrigerant dehydrator, in combination with a refrigeration system of the type including a compressor, a condenser, a refrigerant expansion device, and an evaporator, comprising:

a body member, generally describing a U-shape configuration, the body member incorporating walls surrounding and describing a refrigerant conducting bore operationally interposed between said refrigerant expansion device and said evaporator;

a sump member incorporating walls surrounding and describing a bore, the sump member communicating with the lower portion of the body member and extending downward therefrom such that the bore of the body member communicates with the bore of the sump member; and A drain valve sealably connected to the lower portion of the sump member whereby water accumulated in the sump member may be drained therefrom.

2. The combination of claim 1 wherein a wall of the body member surrounds and defines an orifice interposed between the bore of the body member and the bore of the sump member.

3. The combination of claim 2 wherein the sump member incorporates heating means such that the space surrounded by the walls of the sump member may be maintained at a temperature above the freezing point of water.

4. The combination of claim 2 wherein the sump member incorporates a sight glass for guaging the liquid contents therein.

5. The combination of claim 1 further comprising a pump means sealably connected to the discharge of the drain valve whereby any water accumulated within the sump member may be discharged into an atmosphere of higher pressure than that of the bore of the sump mamber.

6. A refrigerant dehydrator, in combination with a refrigeration system of the type including a compressor, a condenser, a refrigerant expansion device, and an evaporator, comprising:

a body member, generally describing a U-shape configuration, the body member incorporating walls surrounding and describing a refrigerant conducting bore operationally interposed between said refrigerant expansion device and said evaporator, a wall of the body member, at approximately the lowest portion of the body member, further surrounding and describing an orifice;

a sump member incorporating walls surrounding and describing a bore, the sump member sealably connected to the body member and extending downwardly therefrom such that the bore of the body member communicates through the orifice with the bore of the sump member, the lower portion of the sump member incorporating a substantially cylindrical tubular section concentrically reducing to surround a drainage bore at the base thereof, the lower portion of the sump member incorporating threads integrally formed within the exterior circumference thereof;

a cap member incorporating substantially cylindrical side walls and one closed end, the cap member incorporating inner threads appropriately sized for threadably engaging the lower portion of the sump member, the side wall of the cap member surrounding and describing an outlet bore; and a sealing member interposed between the discharge bore of the sump member and the inner surface of the closed end of the cap member.

7. The combination of claim 6 wherein the sump member incorporates heating means such that the space surrounded by the walls of the sump member may be maintained at a temperature above the freezing point of water.

8. The combination of claim 6 wherein the exterior of the body member is insulated.

9. The combination of claim 6 wherein the sump member incorporates a sight glass whereby the liquid contents therein may be gauged.

* * * * *